US009073719B2

(12) United States Patent
Cheng et al.

(10) Patent No.: US 9,073,719 B2
(45) Date of Patent: Jul. 7, 2015

(54) TAPE CONNECTING APPARATUS

(71) Applicant: Wistron Corporation, New Taipei (TW)

(72) Inventors: Jay Cheng, New Taipei (TW); Linsen Kong, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 277 days.

(21) Appl. No.: 13/888,391

(22) Filed: May 7, 2013

(65) Prior Publication Data

US 2014/0290046 A1 Oct. 2, 2014

(30) Foreign Application Priority Data

Mar. 29, 2013 (CN) ..... 2013 1 0109027

(51) Int. Cl.

| | |
|---|---|
| ***B25B 1/22*** | (2006.01) |
| ***B23Q 3/00*** | (2006.01) |
| ***B25B 27/00*** | (2006.01) |
| ***B65H 21/00*** | (2006.01) |

(52) U.S. Cl.

CPC ..... *B65H 21/00* (2013.01); *Y10T 29/53* (2015.01); *B65H 2301/4622* (2013.01); *B65H 2301/4632* (2013.01); *B65H 2301/4641* (2013.01)

(58) Field of Classification Search

CPC .... B65H 21/00; B65H 19/18; B65H 19/1836; B25H 3/00; B25H 3/06; B25H 1/12; B25H 1/10

USPC ..... 29/270, 243.5, 278, 268, 263; 269/71, 269/11, 76, 97, 901; 312/314

See application file for complete search history.

(56) References Cited

U.S. PATENT DOCUMENTS

| | | | | |
|---|---|---|---|---|
| 1,660,521 | A * | 2/1928 | Nordgren | 211/70.6 |
| 2,819,938 | A * | 1/1958 | Zerver | 312/201 |
| 3,834,725 | A * | 9/1974 | Luoni | 280/79.2 |
| 4,265,283 | A * | 5/1981 | Nash et al. | 144/286.5 |
| 5,078,414 | A * | 1/1992 | Court et al. | 280/42 |
| 5,785,304 | A * | 7/1998 | Little | 269/16 |
| 5,971,512 | A * | 10/1999 | Swan | 312/281 |
| 7,581,320 | B2 * | 9/2009 | Achiwa et al. | 30/131 |
| 2002/0038584 | A1 * | 4/2002 | Asai et al. | 81/418 |

* cited by examiner

*Primary Examiner* — Lee D Wilson
*Assistant Examiner* — Seahee Yoon
(74) *Attorney, Agent, or Firm* — Winston Hsu; Scott Margo

(57) ABSTRACT

A tape connecting apparatus for connecting a brass buckle to remaining and unused tapes, includes a support base, a platform, a support pillar, and a clamp device including a tape connecting base and a tape connecting clamp. The platform is disposed on the support base. The support pillar rotatably stands on the platform. The tape connecting base is detachably disposed at a top end of the support pillar. The tape connecting clamp has upper and lower handles respectively pivoted to the tape connecting base. The upper handle has a clamp head and is pivoted to the lower handle. When the brass buckle, the remaining tape and the unused tape are positioned on the tape connecting base, the upper and lower handles are rotated relatively to drive the clamp head to press the brass buckle, so that the unused tape could be connected to the remaining tape via the brass buckle.

17 Claims, 4 Drawing Sheets

TAPE CONNECTING APPARATUS

BACKGROUND OF THE INVENTION

1. Field of the Invention

The present invention relates to a tape connecting apparatus, and more specifically, to a tape connecting apparatus of disposing a clamp device on a platform via a support pillar.

2. Description of the Prior Art

In general, a conventional tape supplement design applied to the surface mounting technology involves utilizing a tape connecting clamp to connect a remaining tape to an unused tape. However, since related objects for tape connection (e.g. a radio-frequency data recess device, brass buckles, and a scissor) are placed dispersedly, it is inconvenient for an operator to take the aforesaid related objects quickly, so as to cause the operator much inconvenience in tape connection and the problem that these dispersedly-placed objects may be damaged easily during the tape connection process.

Furthermore, since there is no support platform for placing the tape connecting clamp, the remaining tape, and the unused tape, the operator needs to take all of them on his hand while utilizing the tape connecting clamp to connect the remaining tape to the unused tape. Thus, the problem that the remaining tape could be connected to the unused tape in a loose manner may occur so as to influence the connection quality and efficiency of the remaining tape and the unused tape.

SUMMARY OF THE INVENTION

An objective of the present invention is to provide a tape connecting apparatus of disposing a clamp device on a platform via a support pillar to solve the aforesaid problems.

The present invention provides a tape connecting apparatus for connecting a brass buckle to a remaining tape and an unused tape. The tape connecting apparatus includes a support base, a platform, a support pillar, and a clamp device. The platform is disposed on the support base. The support pillar rotatably stands on the platform. The clamp device includes a tape connecting base and a tape connecting clamp. The tape connecting base is detachably disposed at a top end of the support pillar. The tape connecting clamp has an upper handle and a lower handle respectively pivoted to the tape connecting base. The upper handle has a clamp head and is pivoted to the lower handle. The upper and lower handles rotates relatively to drive the clamp head to press the brass buckle when the brass buckle, the remaining tape and the unused tape are positioned on the tape connecting base, so that the unused tape could be connected to the remaining tape via the brass buckle.

According to the claimed invention, the tape connecting base has a buckle fixing pillar for penetrating through the brass buckle so as to position the brass buckle on the tape connecting base.

According to the claimed invention, the tape connecting base further has a first rotatable pillar and a second rotatable pillar for respectively fixing the remaining tape and the unused tape on the tape connecting base when rotating to a fixing position and for respectively separating from the remaining tape and the unused tape when rotating to a releasing position.

According to the claimed invention, a reel hook is formed at a side of the platform for hanging a tape reel wrapped with the unused tape.

According to the claimed invention, the platform has at least one tape placing groove.

According to the claimed invention, the platform further has a buckle pacing groove.

According to the claimed invention, the platform further has at least one auxiliary tool placing groove.

According to the claimed invention, the platform further has at least one computer related object placing groove.

According to the claimed invention, at least one heat dissipating hole is formed at a side of the computer related object placing groove.

According to the claimed invention, the support base includes a chassis and at least one telescopic rod. The telescopic rod is connected to the platform and the chassis for adjusting a height of the platform relative to the chassis.

According to the claimed invention, the support base further includes a plurality of wheels disposed under the chassis.

According to the claimed invention, the chassis has an empty reel placing rod.

In summary, the present invention adopts the design that the support pillar stands on the platform and the clamp device is disposed on the support pillar, to make the tape connecting apparatus capable of providing a steady support platform for the operator to perform the tape connecting operation smoothly and quickly. In such a manner, since the operator does not need to take the tape connecting clamp, the unused tape, and the remaining tape on his hand any more, the tape connecting apparatus provided by the present invention could efficiently enhance the connection quality and efficiency of the remaining tape and the unused tape, so as to solve the prior art problem that the remaining tape is connected to the unused tape in a loose manner. Furthermore, compared with the prior art placing the related objects for tape connection (e.g. tapes, a radio-frequency data recess device, brass buckles, and a scissor) dispersedly, the present invention adopts the design that the clamp device and the platform are disposed on the support base and the platform has the corresponding grooves formed thereon for placing the aforesaid related objects. Accordingly, the operator could take the aforesaid objects conveniently and quickly while utilizing the clamp device to perform the tape connection process, so as to improve operational convenience of the tape connecting apparatus and solve the prior art problem that the dispersedly-placed objects may be damaged easily during the tape connection process.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
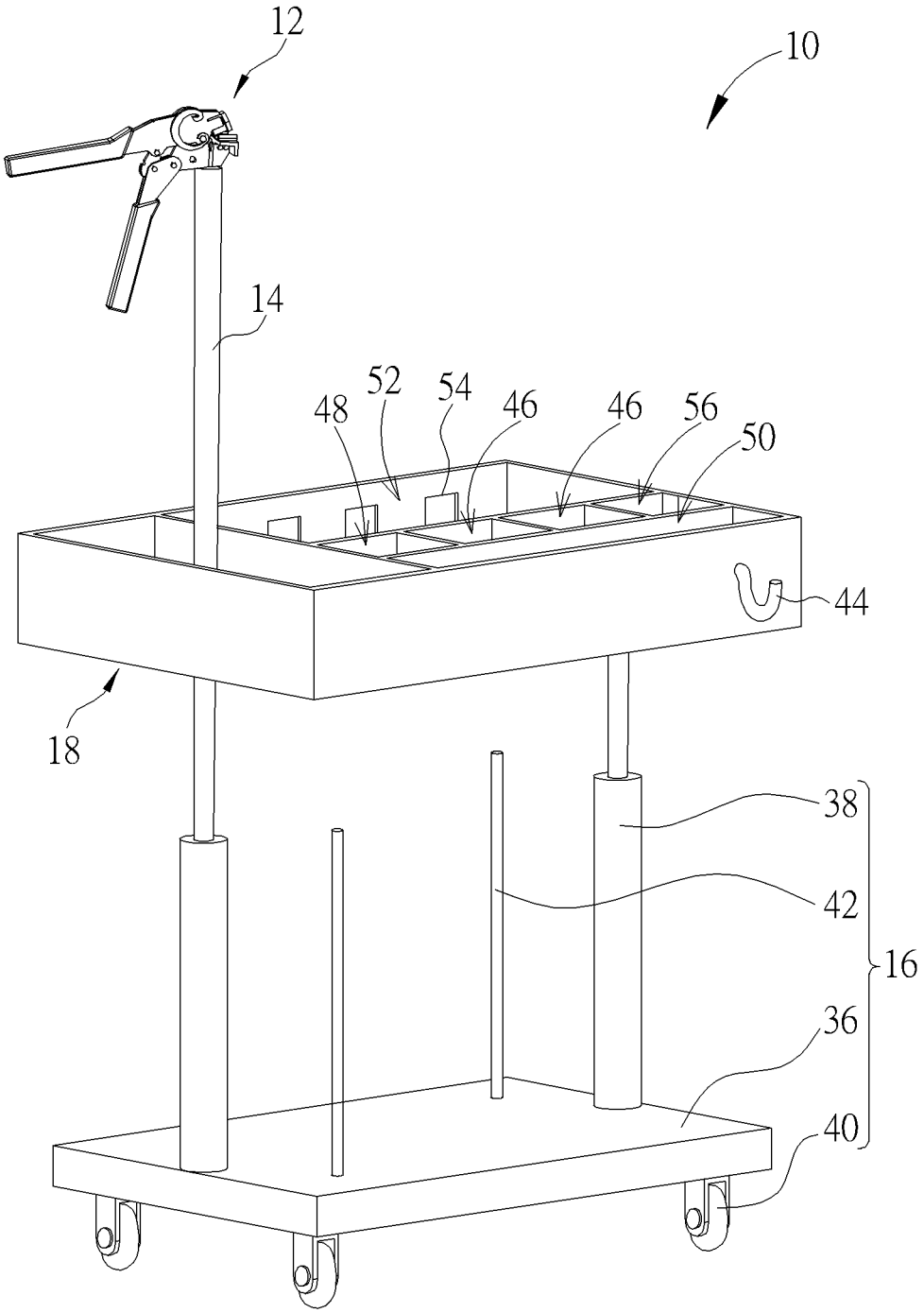
FIG. 1 is a diagram of a tape connecting apparatus according to an embodiment of the present invention.

Please refer to FIG. 1, which is a diagram of a tape connecting apparatus 10 according to an embodiment of the present invention. The tape connecting apparatus 10 is used for connecting a brass buckle to a remaining tape and an unused tape. As shown in FIG. 1, the tape connecting apparatus 10 includes a clamp device 12, a support pillar 14, a support base 16, and a platform 18.

Figure 2:
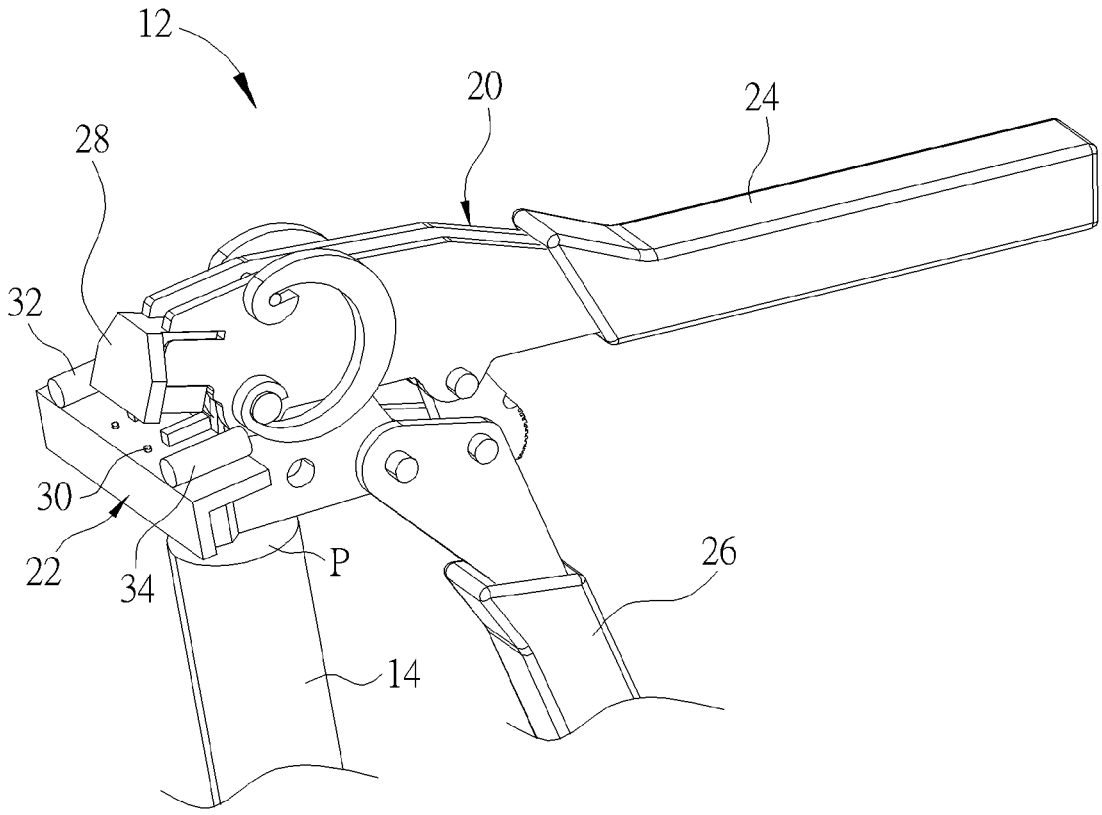
FIG. 2 is a partial enlarged diagram of a clamp device in FIG. 1.

The designs of the clamp device 12 and the support pillar 14 are described first as follows. Please refer to FIG. 1 and FIG. 2. FIG. 2 is a partial enlarged diagram of the clamp device 12 in FIG. 1. As shown in FIG. 1 and FIG. 2, the clamp device 12 includes a tape connecting clamp 20 and a tape connecting base 22. The tape connecting clamp 20 has an upper handle 24 and a lower handle 26 respectively pivoted to the tape connecting base 22. The upper handle 24 could have a clamp head 28 and is pivoted to the lower handle 26, so that an operator could hold the upper handle 24 and the lower handle 26 towards each other to move the clamp head 28 downward to perform a buckle pressing operation cooperatively with the tape connecting base 22. As for description for the other mechanical designs of the tape connecting clamp 20, it is commonly seen in the prior art and therefore omitted herein. The tape connecting base 22 is detachably disposed on a top end P of the support pillar 14 and the support pillar 14 rotatably stands on the platform 18, so that the clamp device 12 could take the support pillar 14 as a rotating shaft to rotate relative to the platform 18. In such a manner, it is convenient for the operator to rotate the clamp device 12 to an appropriate angle where the operator could perform the tape connecting operation conveniently.

Furthermore, in this embodiment, the tape connecting base 22 could have at least one buckle fixing pillar 30 (two shown in FIG. 2, but not limited thereto). The buckle fixing pillar 30 is used for penetrating through a brass buckle and then positioning the brass buckle on the tape connecting base 22. Furthermore, the tape connecting base 22 could further have a first rotatable pillar 32 and a second rotatable pillar 34. The first rotatable pillar 32 and the second rotatable pillar 34 could respectively fix a remaining tape and an unused tape on the tape connecting base 22, or rotate to be separate from the remaining tape and the unused tape respectively so that the operator could remove the remaining tape and the unused tape from the tape connecting base 22 easily.

The design of the support base 16 could be as shown in FIG. 1. In this embodiment, the support base 16 could include a chassis 36, at least one telescopic rod 38 (two shown in FIG. 1, but not limited thereto), and a plurality of wheels 40. The telescopic rod 38 is connected to the platform 18 and the chassis 36 for adjusting a height of the platform 18 relative to the chassis 36. The plurality of wheel 40 is disposed under the chassis 36 so that the operator could push the tape connecting apparatus 10 to go forward or backward in any direction to a position where the operator could perform the tape connecting operation conveniently. Accordingly, operational mobility of the tape connecting apparatus 10 could be further improved. Furthermore, for improving operational convenience of the tape connecting apparatus 10, in this embodiment, the chassis 36 could have an empty reel placing rod 42 for placing at least one empty reel.

The design of the platform 18 is as shown in FIG. 1. In this embodiment, a reel hook 44 is formed at a side of the platform 18. The reel hook 44 is used for hanging a reel wrapped with an unused tape. Furthermore, in this embodiment, the platform 18 could have two tape placing grooves 46 (but not limited thereto), a buckle placing groove 48, at least one auxiliary tool placing groove 50 (one shown in FIG. 1, but not limited thereto), and a computer related object placing groove 52. The two tape placing grooves 46 are used for placing tapes with different sizes, such as 8 mm tape and 16 mm tape, and the buckle placing groove 48 is used for placing brass buckles for tape connection. Accordingly, the operator could take the tapes and the brass buckles conveniently and quickly during the operator utilizes the clamp device 12 to perform the tape connection process. The auxiliary tool placing groove 50 is used for placing conventional auxiliary tools for tape connection, such as a scissor and a radio-frequency data recess device. The computer related object placing groove 52 is used for placing computer related objects for tape connection, such as a display monitor and a notebook for monitoring the tape use condition. In this embodiment, as shown in FIG. 1, at least one heat dissipating hole 54 (three shown in FIG. 1, but not limited thereto) is formed at a side of the computer related object placing groove 52 for heat dissipation. To be noted, the groove design of the platform 18 is not limited to the aforesaid embodiment, meaning that it may vary with the amount and type of objects needed for tape connection. For example, the platform 18 could further have a mouse placing groove 56 for directly placing a mouse to operate the aforesaid notebook on the platform 18.

Figure 3:
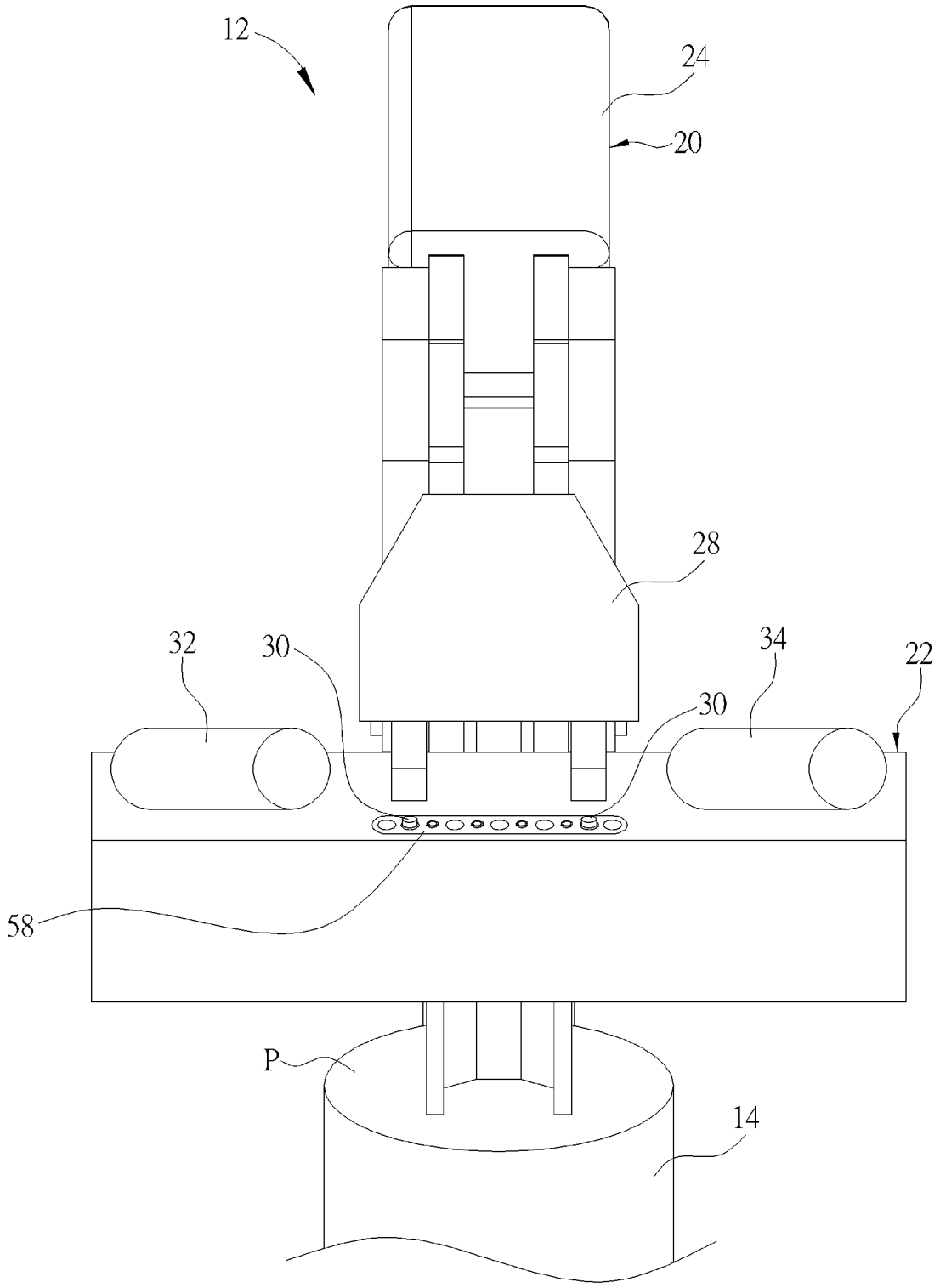
FIG. 3 is a diagram of a brass buckle being placed on a tape connecting base in FIG. 2.
Figure 4:
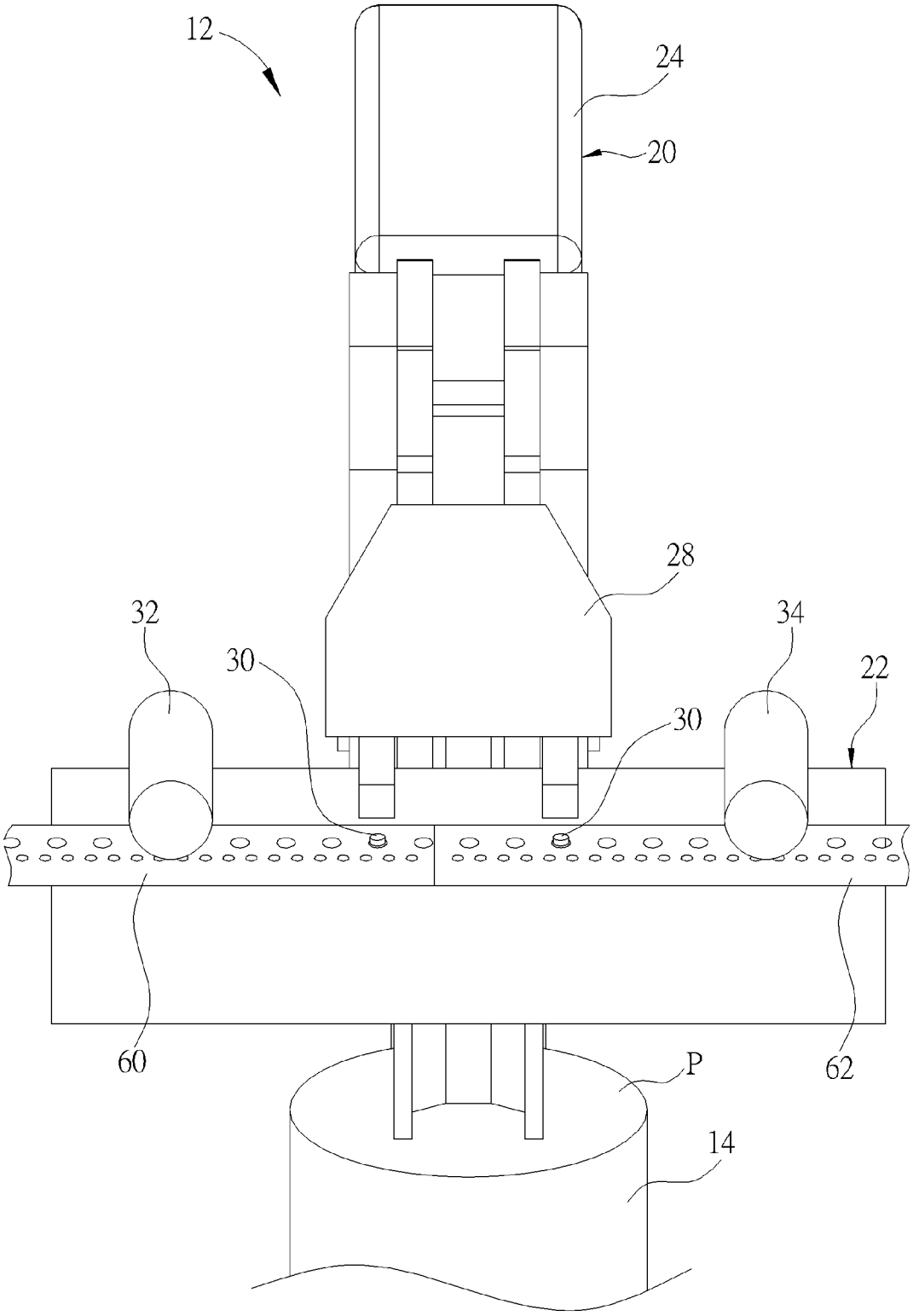
FIG. 4 is a diagram of an unused tape and a remaining tape being placed on the tape connecting base in FIG. 3.

More detailed description for the tape connecting operation of the tape connecting apparatus 10 is provided as follows. Please refer to FIG. 2, FIG. 3, and FIG. 4. FIG. 3 is a diagram of a brass buckle 58 being placed on the tape connecting base 22 in FIG. 2. FIG. 4 is a diagram of an unused tape 60 and a remaining tape 62 being placed on the tape connecting base 22 in FIG. 3. First, an operator could put the brass buckle 58, which is depicted briefly by dotted lines in FIG. 3, on the buckle fixing pillar 30 of the tape connecting base 22. The brass buckle 58 adopts a conventional buckle design for tape connection. For example, in this embodiment, the brass buckle 58 could preferably have a tooth structure (not shown in FIG. 3) formed thereon for piecing into tapes positioned on the tape connecting base 22. The related structural design for the brass buckle 58 is commonly seen in the prior art, and its description is therefore omitted herein.

After the brass buckle 58 is positioned on the tape connecting base 22 (as shown in FIG. 3), the operator could fold the connecting head of the unused tape 60 and the connecting head of the remaining tape 62 on the brass buckle 58 sequentially, and then rotate the first rotatable pillar 32 and the second rotatable pillar 34 from a releasing position as shown in FIG. 3 to a fixing position as shown in FIG. 4 so as to fix the unused tape 60 and the remaining tape 62 on the tape connecting base 22 (as shown in FIG. 4).

Subsequently, the operator could hold the upper handle 24 of the lower handle 26 towards each other to make the upper handle 24 and the lower handle 26 rotate relatively to move the clamp head 28 downward to press the brass buckle 58, the unused tape 60, and the remaining tape 62 positioned on the tape connecting base 22 cooperatively with the tape connecting base 22. During the aforesaid process, the tooth structure of the brass buckle 58 could be driven by the pressing force provided by the clamp head 28 and the tape connecting base 22, to piece into the unused tape 60 and the remaining tape 62. In such a manner, the unused tape 60 could be connected to the remaining tape 62 via the brass buckle 58 so as to complete the tape connecting operation of the tape connecting apparatus 10. To be noted, during the aforesaid process, via the design that the support pillar 14 stands on the platform 18 and the tape connecting base 22 is disposed on the support pillar 14, the tape connecting apparatus 10 could provide a steady support platform for the operator to utilize the clamp device 12 to clamp the brass buckle 58, the unused tape 60 and the remaining tape 62 tightly. Accordingly, the connection quality and efficiency of the unused tape 60 and the remaining tape 62 could be improved, so as to solve the prior art problem that the remaining tape is connected to the unused tape in a loose manner.

Finally, the operator just needs to rotate the first rotatable pillar 32 and the second rotatable pillar 34 from the fixing position as shown in FIG. 4 to the releasing position as shown in FIG. 3. Accordingly, the operator could remove the unused tape 60 and the remaining tape 62 connected by the brass buckle 58 from the tape connecting base 22 conveniently, and then utilize the unused tape 60 with the remaining tape 62 to perform the subsequent tape supplement operation. As for the subsequent tape supplement operation, such as sticking adhesives on the unused tape 60, winding the unused tape 60 with the remaining tape 62 around a tape reel, and then placing the tape reel on a tape feeder, its related description is commonly seen in the prior art and therefore omitted herein.

In summary, the present invention adopts the design that the support pillar stands on the platform and the clamp device is disposed on the support pillar, to make the tape connecting apparatus capable of providing a steady support platform for the operator to perform the tape connecting operation smoothly and quickly. In such a manner, since the operator does not need to take the tape connecting clamp, the unused tape, and the remaining tape on his hand any more, the tape connecting apparatus provided by the present invention could efficiently enhance the connection quality and efficiency of the remaining tape and the unused tape, so as to solve the prior art problem that the remaining tape is connected to the unused tape in a loose manner. Furthermore, compared with the prior art placing the related objects for tape connection (e.g. tapes, a radio-frequency data recess device, brass buckles, and a scissor) dispersedly, the present invention adopts the design that the clamp device and the platform are disposed on the support base and the platform has the corresponding grooves formed thereon for placing the aforesaid related objects. Accordingly, the operator could take the aforesaid objects conveniently and quickly while utilizing the clamp device to perform the tape connection process, so as to improve operational convenience of the tape connecting apparatus and solve the prior art problem that the dispersedly-placed objects may be damaged easily during the tape connection process.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A tape connecting apparatus comprising:
a support base;
a platform disposed on the support base;
a support pillar rotatably standing on the platform; and
a clamp device comprising:
a tape connecting base detachably disposed at a top end of the support pillar; and
a tape connecting clamp having an upper handle and a lower handle respectively pivoted to the tape connecting base, the upper handle having a clamp head and being pivoted to the lower handle, the upper and lower handles rotating relatively to drive the clamp head to press a brass buckle when the brass buckle, a remaining tape and an unused tape are positioned on the tape connecting base, so that the unused tape could be connected to the remaining tape via the brass buckle.

2. The tape connecting apparatus of claim 1, wherein the tape connecting base has a buckle fixing pillar for penetrating through the brass buckle so as to position the brass buckle on the tape connecting base.

3. The tape connecting apparatus of claim 2, wherein the tape connecting base further has a first rotatable pillar and a second rotatable pillar for respectively fixing the remaining tape and the unused tape on the tape connecting base when rotating to a fixing position and for respectively separating from the remaining tape and the unused tape when rotating to a releasing position.

4. The tape connecting apparatus of claim 1, wherein a reel hook is formed at a side of the platform for hanging a tape reel wrapped with the unused tape.

5. The tape connecting apparatus of claim 4, wherein the platform has at least one tape placing groove.

6. The tape connecting apparatus of claim 5, wherein the platform further has a buckle pacing groove.

7. The tape connecting apparatus of claim 6, wherein the platform further has at least one auxiliary tool placing groove.

8. The tape connecting apparatus of claim 7, wherein the platform further has at least one computer related object placing groove.

9. The tape connecting apparatus of claim 8, wherein at least one heat dissipating hole is formed at a side of the computer related object placing groove.

10. The tape connecting apparatus of claim 1, wherein the support base comprises:
a chassis; and
at least one telescopic rod connected to the platform and the chassis for adjusting a height of the platform relative to the chassis.

11. The tape connecting apparatus of claim 10, wherein the support base further comprises:
a plurality of wheels disposed under the chassis.

12. The tape connecting apparatus of claim 10, wherein the chassis has an empty reel placing rod.

13. The tape connecting apparatus of claim 1, wherein the platform has at least one tape placing groove.

14. The tape connecting apparatus of claim 1, wherein the platform further has a buckle pacing groove.

15. The tape connecting apparatus of claim 1, wherein the platform further has at least one auxiliary tool placing groove.

16. The tape connecting apparatus of claim 1, wherein the platform further has at least one computer related object placing groove.

17. The tape connecting apparatus of claim 16, wherein at least one heat dissipating hole is formed at a side of the computer related object placing groove.

* * * * *